United States Patent [19]

Gondouin

[11] 4,207,827

[45] Jun. 17, 1980

[54] SYSTEM, TOOLING AND METHOD OF CONSTRUCTION OF CRYOGENIC TANKS FOR LNG TANKERS AND FOR LNG STORAGE

[76] Inventor: Michel Gondouin, 32 San Marino Dr., San Rafael, Calif. 94901

[21] Appl. No.: 853,866

[22] Filed: Nov. 22, 1977

Related U.S. Application Data

[63] Continuation-in-part of Ser. No. 716,176, Aug. 20, 1976, abandoned.

[51] Int. Cl.[2] ..... B63B 25/08; B65D 25/18

[52] U.S. Cl. ..... 114/74 A; 114/77 R; 220/467; 220/901

[58] Field of Search ..... 52/2, 309; 114/65 R, 114/69, 74 A, 77 R, 79 W, 266, 267; 156/497; 220/9 LG, 15

[56] References Cited

U.S. PATENT DOCUMENTS

| | | | |
|---|---|---|---|
| 3,411,656 | 11/1968 | Jackson | 114/74 A X |
| 3,658,627 | 4/1972 | Kaminsky | 156/497 |
| 3,753,413 | 8/1973 | Ichikawa et al. | 114/65 R |
| 3,861,021 | 1/1975 | Yamamoto | 114/74 A X |
| 3,878,806 | 4/1975 | Garcia | 114/77 R |
| 3,931,424 | 1/1976 | Helf et al. | 114/74 A X |
| 3,941,272 | 3/1976 | McLaughlin | 114/74 A X |

FOREIGN PATENT DOCUMENTS

| | | | |
|---|---|---|---|
| 2265608 | 10/1975 | France | 114/74 A |

*Primary Examiner*—Stephen G. Kunin

[57] ABSTRACT

Prefabricated rigid insulating panels of great length, made of a fiberglass reinforced prestressed foam enclosed in a gas tight envelope and covered on their inner face by a folded metal membrane are glued directly to the cavity walls of the load bearing structure of a cryogenic tank by means of variable thickness adhesive mastic strips, which also separate channels for a gas circulation against the panels' back face. The beveled edge surfaces of adjacent panels are rigidly bonded under pressure. Panel handling, gluing operations, and membrane welding inside the closed space of a tank are done using telescopic towers fitted with four mobile arms, one of them supporting a worker-carrying bucket. Complete self standing inner tanks may also be assembled outside and inserted into the cavity of a vessel before it is covered over. Inflated air hoses attached to the outer faces of the inner tank center it inside the cavity during the injection and curing of a liquid thermosetting bonding agent between the cavity walls and the inner tank. The hoses subsequently provide channels for a gas circulation against the back face of each panel for monitoring its integrity.

11 Claims, 19 Drawing Figures

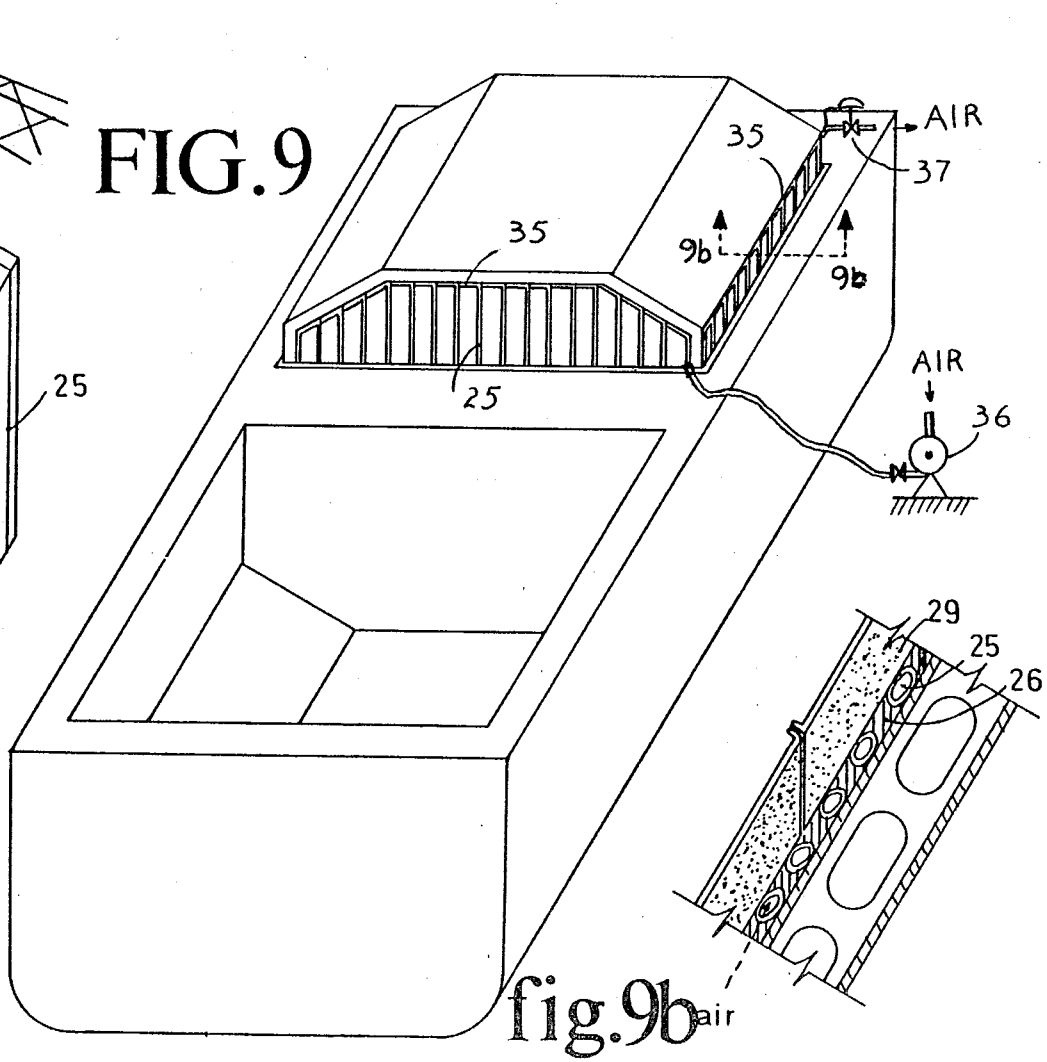
FIG.9
fig.9b
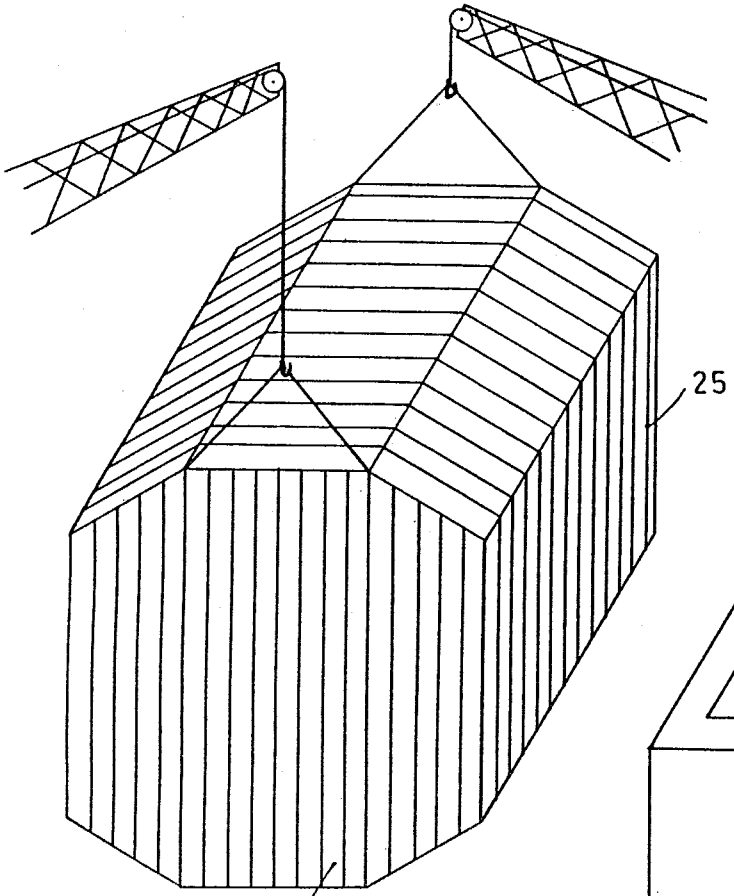
fig.9a

SYSTEM, TOOLING AND METHOD OF CONSTRUCTION OF CRYOGENIC TANKS FOR LNG TANKERS AND FOR LNG STORAGE

This is a continuation in part of application Ser. No. 716,176 filed Aug. 20, 1976, now abandoned.

BACKGROUND OF THE INVENTION

1. Field of the Invention

This invention relates to the insulation and containment system of tanks designed for the storage or transportation of liquid cryogens, and more particularly, those of the membrane type in which the cold liquid is contained in a flexible membrane and its hydrostatic pressure is transmitted by means of a rapid insulation to a load bearing vessel structure remaining at a temperature close to ambient.

2. Description of Prior Art

Bulk Storage and transportation of natural gas, ethylene, nitrogen and other industrial gases, in liquid state under atmospheric pressure and at a cryogenic temperature has been done using storage tanks and tanker ships of various designs, and various safety regulations have been imposed for the design, construction, and use of such tanks or vessels within the United States ports and coastal waters. Liquid Natural Gas boils at a temperature of approximately −160° C. To minimize the atmospheric boiling and vaporization of such a cold liquid it is necessary to reduce to a very low level the heat influx from the ambience to the liquid. This is achieved by a thick layer of thermally insulating material. Insulating materials such as perlite, glass wool and most plastic foams do not have any appreciable strength. Accordingly, they can only be used on the outside of a cold tank which contains the liquid and is capable of withstanding all static and dynamic liquid loads. Such self supporting tanks are generally made of thick welded plates of High Nickel Alloy steel or of Aluminum Alloys. The cryogenic metals have the property of remaining relatively ductile at cryogenic temperatures so that they are less subject to the propagation of fractures than other metals which become brittle at the same temperatures. Because of the high material and welding costs of such thick wall self supporting tanks, another kind of cryogenic liquid containment system is preferably used, which is generally called a membrane cryogenic tank.

In such a system, the insulating material is rigid and has sufficient compressive strength to transmit the static and dynamic liquid loads to an outer tank structure which remains at or near ambient temperature. For that reason, the load bearing tank structure can be made of less expensive, ordinary carbon steel. Such savings are partially offset however by the greater safety requirements imposed by the location of the insulation layer inside a warm tank made of non-cryogenic steel. Because the insulation is made of a rigid material it is subjected to large thermal stresses when its inner face is at −160° C. and the outer face at ambient temperature.

Unless they are relieved by flexible foam expansion joints, such thermal stresses, added to the compressive stress due to static and dynamic liquid loads may cause insulation layers to crack. In such an event, the cryogenic liquid would penetrate into the insulation and would cause a drastic lowering of temperature at some points of the load bearing tank structure. Because the material selected for the construction of such outer tank structure is subject to brittle fracture at low temperature, the tank would fail and the cryogenic liquid might spill out, with potentially catastrophic consequences. To reduce such a hazard, all membrane cryogenic tanks are required to include two successive leak proof barriers. The primary barrier, generally made of a flexible thin gauge cryogenic metal covering the insulation layer, is in direct contact with the cryogenic liquid and must not be liquid-tight but also to a large degree gas tight. The secondary barrier, often located within the insulation layer must also be liquid-tight so as to contain the cryogenic liquid in the event of failure of the primary barrier.

Any liquid leaking past the primary barrier receives sufficient heat from the ambience to vaporize. The resulting cold gas must be vented and the presence of the leak immediately detected. For this reason the space between the primary and secondary barriers, generally called interbarrier space is swept by a circulation of cold gas exhausting into a venting system. The interspace between the secondary barrier and the load bearing structure called the insulation space, is also swept by a gas circulation, the purpose of which is not only to provide additional venting of gas in the event of a leak, but also, in the case of cryogenic tanker ships, to detect any entry of water from the adjacent ballast compartments into the cryogenic tank, resulting from any failure of the double hull of the tanker. Gas permeable insulation space in known designs is created by means of a lattice of discontinuous wood grounds bolted against the tank wall using welded studs and to which the primary insulation panels separated by expansion joints are glued. Known construction methods of membrane cryogenic tanks are based on assembling successively, inside a completed tank structure up to five layers made of small elements constituting the respective parts of membrane containment systems:

(1) the insulation space, including monitoring channels
(2) the secondary load bearing insulation
(3) the secondary barrier (liquid tight)
(4) the primary cryogenic insulation and interbarrier spaces
(5) the primary barrier (gas tight membrane).

Each of the individual elements of such parts of known membrane containment systems, (studs, grounds, washers, nuts, insulation panels, expansion joints, barrier joints, primary insulation panels, membrane panels, membrane joints, etc.) is of sufficiently small dimensions and light weight that it can be handled, positioned and fastened by one or two men using portable tools. This method of construction employs a large number of men working simultaneously from a multi-stage scaffolding covering the entire inner surface of the tank, which scaffolding is later removed.

The presence of a large number of workers inside the closed tank requires the installation in the tank of adequate ventilation systems, which are also subsequently removed. The only access for bringing into the closed tank all such elements of the containment system, workers with their portable tools, and all parts of the removable scaffolding and ventilation system is through the hatch openings on the tank tops.

Conventional design of the ship tank structure places stringent limitations on the maximum dimensions of such openings, which control some of the dimensions of said elements and parts, and limit the circulation of men and materials. Throughout the construction of the tank and during the subsequent dismantling and removal of the multi-stage scaffolding and of the ventilation systems great care must be taken to avoid the accidental drop of any element, hand tool, scaffolding or ventilation part onto the lower areas of the cryogenic tank, which would be severely damgaged by the impact of such falling objects.

The known methods of construction of membrane tanks, in successive layers, also require sequential testing of the assembled elements at each step of the construction of the containment system pulling tests on studs, levelling and alignment of grounds arranged in a rectangular grid, compression of foam expansion joints, leak proofing of all joints of the secondary and primary barriers, etc.). The assembly of a large number of small elements, builtup in successive layers and sequentially tested, by a large number of men working on a multistage scaffolding, which characterizes such known methods of construction, applicable to known membrane containment systems, results in very high labor costs and in a lengthy construction time, which increases the financial burden associated with the immobilization of capital invested in the unfinished ship, tanks, and construction facilities.

To reduce the high cost of membrane-type cryogenic tanks, various wet wall systems have been described, in which at least one of the liquid-tight barriers is omitted, for instance the primary metallic barrier. In that case, the safety of the system is entirely dependent upon the pressure equilibrium between the liquid hydrostatic load and the vapor pressure of a small amount of liquid trapped in the inner surface of the insulating foam, and partially vaporized. A major drawback of these wet wall systems is the presence of combustible gas in the insulating walls of the tanks when in service, which makes it difficult to gas-free them sufficiently for inspection or repairs. Such wet wall systems do not fall into the category of membrane cryogenic tanks, recognized by ship classification society and by the U.S. Coast Guard. They do not provide the same redundant safety features as the true membrane systems, namely a primary and secondary barrier, the integrity of which can be monitored for the containment of the cold liguid.

SUMMARY OF THE INVENTION

While retaining all basic features of true membrane cryogenic tanks, the present invention aims at reducing the labor costs and constuction time of such tanks, so as to decrease the total cost of cryogenic tanker ships and storage tanks.

To this end, the system, tooling and method of construction, subject of the invention depart from known construction methods of membrane tank containment systems through the use of prefabricated panels, individually prestressed to compensate thermal stresses, which combine in a rigid structural composite both primary and secondary insulation and include both primary and secondary barriers.

Because these machine-made composite panels already include a metallic cryogenic membrane, fastened to a fiberglass reinforced plastic foam insulation enclosed and compressed into an impervious fiberglass reinforced plastic envelope serving as secondary barrier, the membrane tank containment system made of such panels bonded together is assembled without building-up, in successive layers, the basic constitutive elements of a membrane system. The cross sectional area of said prefabricated panels is sufficiently small compared to the size of the hatch opening, to permit their easy insertion into the tank, but their length is such that, except for twice the half width of the edge panels, it covers the full distance separating the opposing edges of any face of a prismatic tank in a ship, or the full height of a cylindrical storage tank (about 60 ft). Handling and precise positioning of such full-length prefabricated panels is made possible by the use of specially designed tooling, described herein. Such tooling includes mobile towers, circulating on rails fastened along the periphery of the tank bottom. Within the confined space of the tank, which provides only a small clearance for the longest panels, precise orientation and positioning of the full length panels is accomplished entirely by the horizontal translation of said towers and by the combined horizontal and vertical translations of three telescopic arms supported by the towers.

Because each prefabricated panel has the basic structure of an internally pre-stressed box girder, it presents sufficient inherent rigidity to allow for support on only a part of its back face. This property enables to create between the panel back face and the tank wall a large number of channels, constituting the insulation space which is swept by gas for monitoring the integrity of the tank while in service, a desirable feature of all true membrane systems. Such a feature is provided by the specific procedures used to bond the panels directly to the walls.

Thick parallel adhesive mastic strips of variable thickness are used to affix the panels to the inner tank walls, thus replacing time consuming mechanical fasteners (studs, washers and nuts). The intervals between parallel mastic strips provide as many paths for the circulation of gas within the insulation space, thereby eliminating the need for discontinuous grounds on a rectangular grid. The mastic strips are rapidly heat cured while the panel is held in its proper position so that each full length composite panel is affixed to the tank wall and glued to the adjacent panels in a single operation, requiring minimum labor. Multi-stage scaffolding is made unnecessary through the use of worker-carrying buckets, supported by a fourth telescopic arm on each tower. Spreading of adhesives and of mastic strips, control of panel positioning and welding of all primary membrane joints are all performed from such mobile worker-carrying buckets. Ventilation requirements are simplified and reduced in proportion to the smaller number of men working simultaneously inside the tank. Removal, through hatch openings, of the towers and of bottom rails from the tank after completion can be accomplished with an outside crane in a few lifting operations, at a minimum risk of damage to the completed tank.

Through the use of the full length composite prefabricated panels constituting the containment system described herein, jointless insulated membrane tanks which are self-standing when empty can also be built and tested separately outside the ship or inner tank structure, to be lowered into the cavity of such structures, and subsequently covered by the upper deck or tank top structure, which is then welded to the lower part of said ship or tank structure. This alternate method of construction, not applicable to known membrane tank systems, is made possible through the elimination of flexible expansion joints, by prestressing the rigid foam during the manufacture of individual panels. It provides a further cost reduction and a shorter construction time, when suitable lifting cranes are available to handle the completed tank. The weight of such a complete insulated membrane tank is only a small fraction of the weight of a self-supporting cryogenic metal tank of equal volume, so that the required lifting force of the crane is within the range of the capacity of the cranes currently available in most shipyards. In this alternate method of construction, the insulation space, through which a circulation of gas is required for monitoring the integrity of the tank while in service, is constituted by air inflated hoses separated by intervals filled with a thermosetting plastic adhesive, which provides a discontinuous, resilient bond between the cavity wall and the insulated membrane tank. Prior to the filling of said intervals, the inflated hoses are sufficiently deformable to compensate for any irregularity of the cavity wall. Such hoses play the same part as the air filled intervals between parallel adhesive mastic strips of variable thickness used to affix each individual composite panel to the wall inside completed inner tank structures, under the first mode of construction describes herein.

BRIEF DESCRIPTION OF THE DRAWINGS

FIG. 9 is a perspective view of a tanker hull into which a completed tank has been installed, and ready to receive another one.

FIG. 9A is a perspective view of an inner tank being lifted into the partially completed hull of FIG. 9

FIG. 9B is a sectional view showing the inflated hoses and resin bonding between the inner tank wall and the side of the partially completed hull of FIG. 9.

DETAILED DESCRIPTION

Figure 2A:
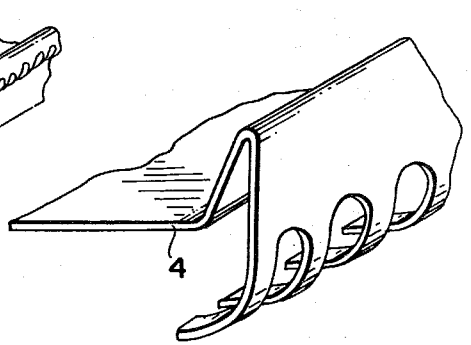
FIG. 2A is a detail showing the folded edge and deformable anchoring of the cryogenic metal membrane.
Figure 2:
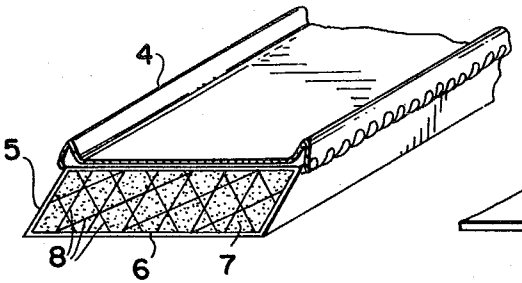
FIG. 2 is a perspective view partially broken away of a prefabricated flat insulation panel.
Figure 2B:
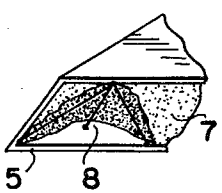
FIG. 2B is a detail showing the orientation of the panel glass fibers.
Figure 1:
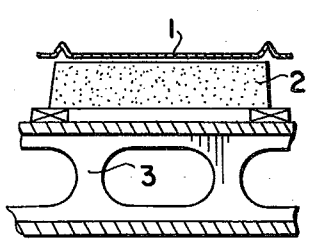
FIG. 1 is a sectional view of a membrane tank wall.
Figure 3:
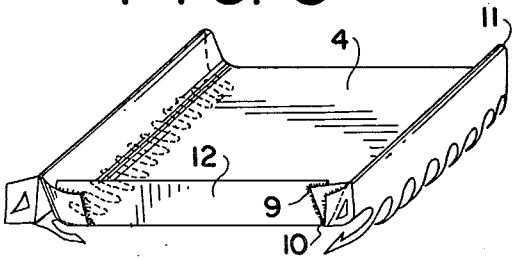
FIG. 3 is a perspective view showing how the edges of the metal membrane of a panel are cut, folded, and welded.

FIG. 1 shows the main features of a complete membrane tank wall, with the primary membrane 1, the rigid insulation 2, and the load-bearing structure 3. FIG. 2 shows the type of prefabricated panels with beveled edge surfaces used in the construction of the tanks by method described in the present invention. The primary membrane 4 is made of a thin gauge cryogenic metal (Invar, Titanium alloy, stainless steel or copper alloy); it is shaped as indicated on FIGS. 2A, 3, with the upturned longitudinal edges 11 folded into a deformable anchoring and with the transversal edges 12 upturned and welded to the longitudinal edges as shown in 9 and 10.

On FIG. 2 the secondary barrier is constituted by the glass fabric envelope 5–6 enclosing the foam insulation 7 prestressed in compression, by oblique glass fibers 8 so that the foam can withstand thermal contraction in the absence of any flexible joints. The edge surfaces of the panel envelope are beveled, so as to increase the area of the bonded joint, for greater strength, and to lower the heat loss. Proper alignment of adjacent panels into the same plane surface is also made easier by the beveled surfaces. The taut glass reinforcing fibers along joining opposite or adjacent faces of the envelope are located along 3 oblique directions with respect to the membrane-covered face of the panel.

Figure 4:
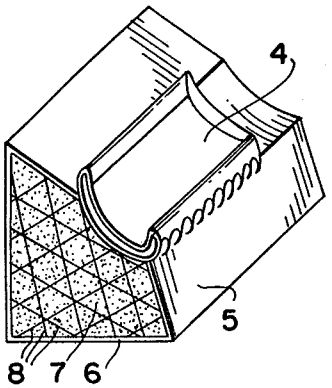
FIG. 4 is a perspective view, partially broken away showing the connection between the membranes of adjacent panels and bellows, of an edge panel.

FIG. 4 shows a special panel used along the edges of a prismatic tank.

Figure 5:
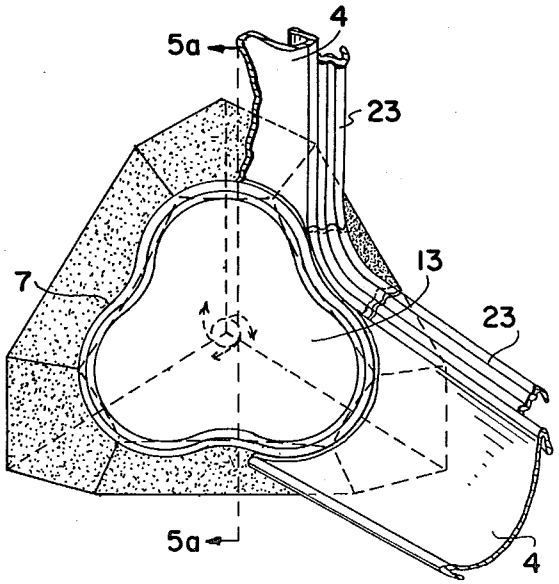
FIG. 5 is an elevation of a trihedral corner panel.
Figure 5A:
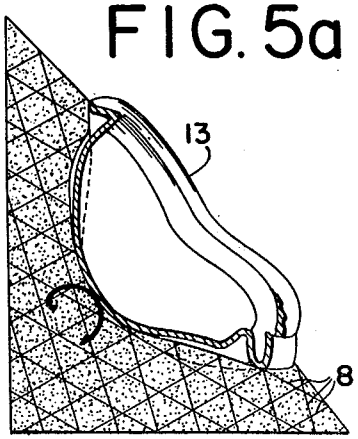
FIG. 5A is a sectional view of the same corner panel.

FIG. 5 shows a special panel used at the corners of a prismatic tank. While differing in shape these special panels also include all the basic elements shown on FIG. 2 for a flat panel. The membrane 4 of the edge panel in FIG. 4 has a concave curved surface, instead of being flat as in FIG. 2. The thin gauge metallic membrane in a corner panel is formed into a concave 3 lobe-dish-shaped piece with corrugated edges. It is fastened at the bottom to an oversized cavity in the foam insulation block, so that the metal cornerpiece, 13, when subjected to tension forces applied on its corrugated edge can freely unfold and expand laterally to fill the cavity in the foam block. Such tension forces originate from the longitudinal contractions of the metal membrane strips of the edge panels, when subjected to a cryogenic temperature.

Figure 6C:
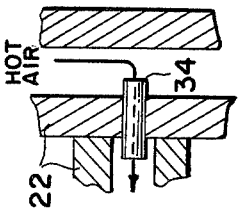
FIG. 6B and 6C show sectional views of details of FIG. 6.
Figure 6B:
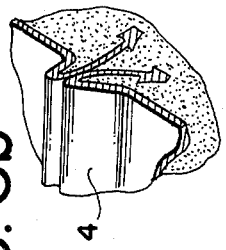
Figure 6A:
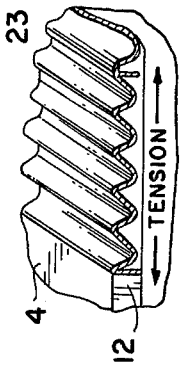
FIG. 6A is a perspective view of a variant of the expansion joint.
Figure 6:
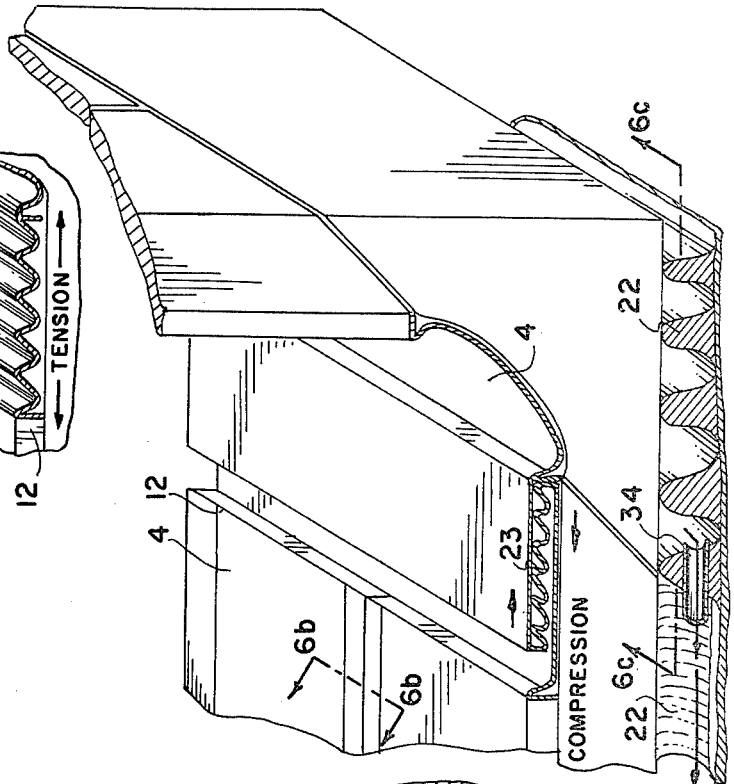
FIG. 6 is a perspective view, partially broken away, of an assembly of panels along the edge of a prismatic tank.

FIG. 6 shows the junction of two wall panels to a special edge panel. To offset the tension applied transversely to the membrane of the edge panels by the transverse edges of the membrane panels on the adjacent wall, a bellows-sype flexible metal joint 23 is welded between the edge panels membrane 4 and the transverse edges 12 of the wall panels, as shown on FIG. 6 for the case of a reverse acting compression bellows and on FIG. 5 for the case of tensions bellows. A direct acting tension bellows is shown in FIG 6A. The upturned and folded longitudinal edges of the membrane of adjacent panels are welded to each other by a continuous weld, as shown on section BB (FIG. 6B). These upturned and folded edges provide a flexible joint capable of offsetting any contraction of the membrane strips in the transverse direction. This system of orthogonal welds, applied to flexible joints, enables the relation of any thermal stresses in the membrane. The choice of a cryogenic metal having a low thermal expansion coefficient such as Invar or Titanium alloys also contributes to the reduction of thermal stresses. With stainless steel and copper alloys, the capacity of the metal to accept large deformations without failure is a contributing factor to the relaxation of thermal stresses offsetting their relatively greater thermal expansion factors. Welding of the membrane edges and flexible joints is preferably done with an automatic welding machine, using the electric arc welding process TIG, or MIG, under an inert gas atmosphere, or using a plasma torch or a laser welding gun. In all cases, the weld is obtained by fusion of the metal at the bottom of the V-shaped trough formed by the adjacent folded edges of both membranes, tightly pressed against each other.

FIG. 6 also shows how the insulating panels are bonded to the irregular surface 3 of the load bearing vessel structure by means of thick parallel strips of adhesive mastic 22 between which a circulation of hot air or gas is established through each channel formed by the wall surface, the back face of the panel and two adjacent mastic strips. The thickness of the mastic strips may be of several inches for a very irregular double hull surface. The hot air stream is used to warm up the resin in the mastic and to accelerate its setting into a hard plastic capable of supporting all loads applied to the insulating panels by the cryogenic liquid. Connecting tubes 34 across a mastic strip permit the hot air to pass from a set of parallel channels under the edge panel to another set of channels perpendicular to the first ones as shown on Section CC (FIG. 6C). In another embodiment of the invention, the hot air channels are materialized by inflated hoses and the internal between them is subsequently filled with a liquid thermosetting resin used as a bonding agent. After completion of the cryogenic tank, the hot air channels are used to circulate gas in the insulation space for leak detection and emergency venting.

Figure 7:
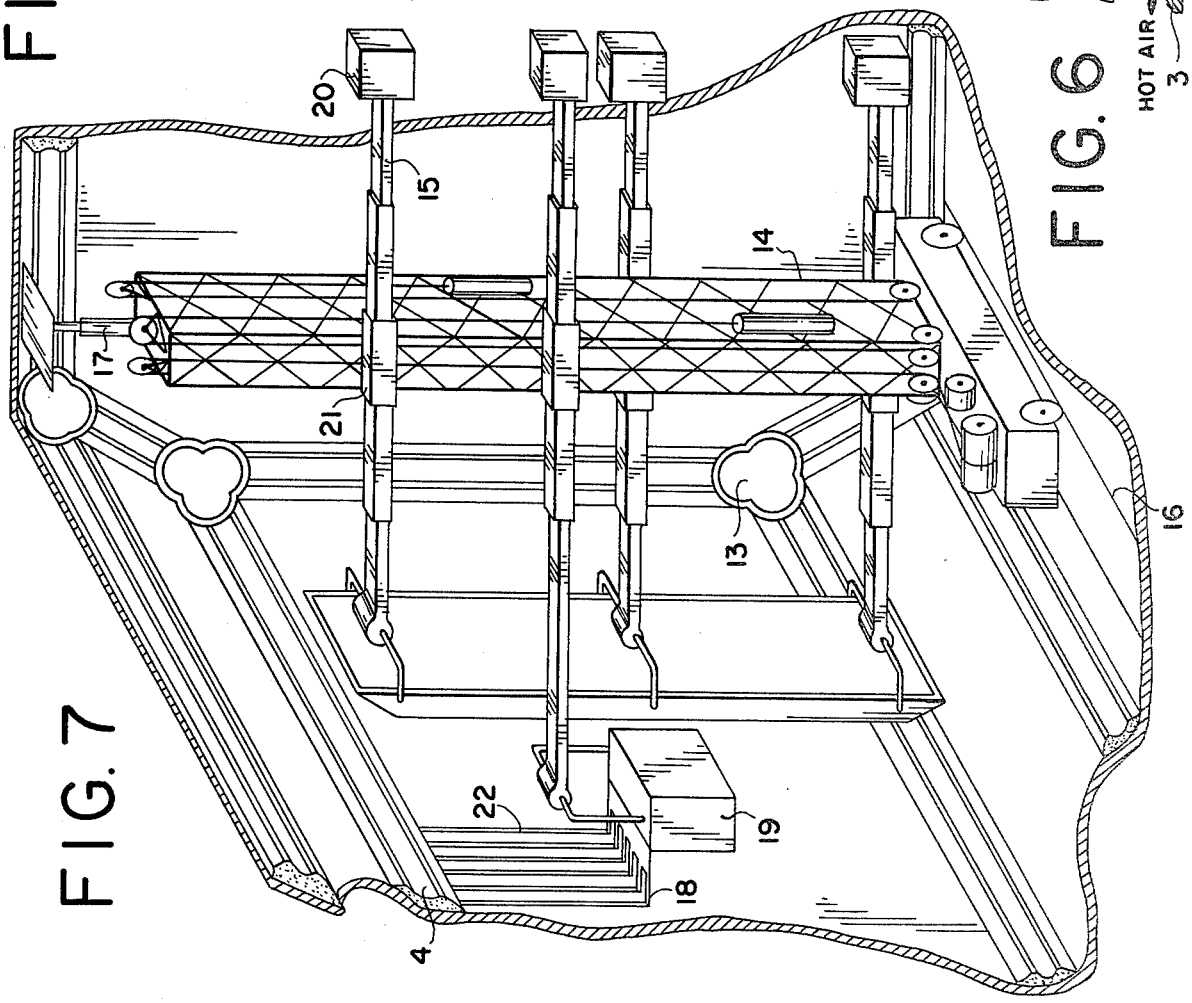
FIG. 7 is a perspective view, partially broken away, of a telescopic tower operating within the enclosed space of a prismatic tank with tank top cut away, for illustration purposes only

FIG. 7 shows one of the mobile telescopic mobile towers used to handle, position and bond the wall panels to the edge panels inside a prismatic tank. The base of such a tower is mobile on rails 16 temporarily welded along the periphery of the bottom of the ship's inner hull. At the top of the square tower structure, a telescopic column 17 is hydraulically extended so as to clamp the upper plate against the ceiling of the inner hull, thus preventing any lateral motion of the tower 14. The tower is equipped with 4 counter-weighted telescopic arms 15, mounted on elevator-type carriages 21 guided along the two sides of the tower structure 14. Each arm is thus controlled individually both in elevation and in extension. The extension of the counterweight 20 is also variable, so as to balance the bending moment on the tower, resulting from the weight of the wall panel being handled. The panel is held in a vertical position by means of articulated clamps at the end of three of the four arms. The fourth arm supports a bucket or cabin 19, in which a worker controls the positioning of the panel against the inner hull surface, and the bonding operations. This cabin is also equipped with special tools, such as a mastic applicator which forms the parallel mastic strips 22 against the hull surface by extrusion of the mastic through a comb-like applicator 18. The strips are extruded while the cabin and its supporting telescopic arm are moving up or down the tower. In this manner, any local irregularity in the surface of the inner hull is compensated by a variation in thickness of the mastic strips. The outer surface of the mastic defines a geometric plane parallel to the tower axis 14 and to the direction of the rails 16. The wall panel is pushed against the mastic strips and held in place by the three telescopic arms. When the panel is fully positioned, and its beleved longitudinal and transverse surfaces are tightly pressed against the adhesive covered surfaces of, respectively, the adjacent wall panel and the top and bottom edge panels, a hot air circulation is established through the channels formed by the inner hull, the panel back-face and any two adjacent mastic strips. Hot air circulation is continued until the mastic has hardened, and all bonded joints have cured.

The panel is then released from its three holding clamps. After checking the gas-tightness of the bonded joints, by applying a differential air pressure across them, the folded edges of the membranes of adjacent panels are welded together, using an automatic welding machine supported by the cabin 19 and guided by the vertical displacement of the carriage 21 against the tower 14. In this manner, the geometry of the insulating tank and membrane liner is entirely determined by the vertical alignment of the tower and the extension of the telescopic arms. Any curvature or irregularity of the inner hull is compensated by variations in the thickness of the mastic strips.

The assembly sequence is the following: The corner panels, with their concave membrane piece 13 are bonded first and accurately positioned using optical surveying instruments. The edge panels are bonded into place to provide a frame in which the wall panels are inserted. For handling the horizontal edge panels and the wall panels on the ceiling of the inner hull, two identical towers are used, one at each end of the tank. To prevent any sagging of the center part of the panel, while it is being positioned, the corresponding arms of one tower are connected to those of the other by means of a rigid beam, over the length of which the cabin, and the tools it carries, travels along a supporting rail.

Figures 8, 8A, 8B, 8C:
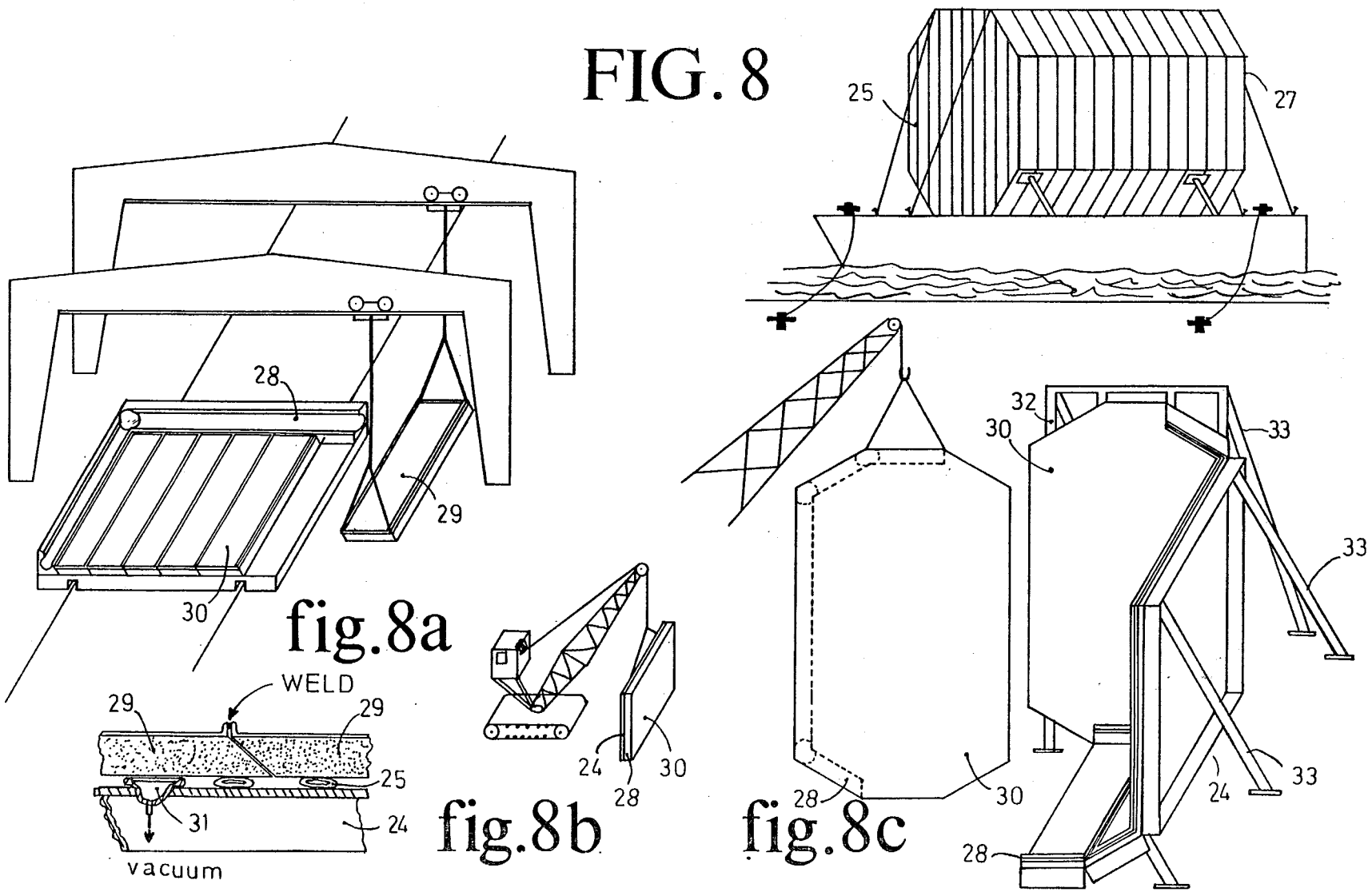
FIG. 8 is a perspective view of inner tanks constructed outside a ship's hull, showing stages (FIG. 8*a*, 8*b*, 8*c*) of the construction

FIG. 8 shows the assembly of a complete cryogenic tanks, at a fabrication facility, outside the hull of a ship. Each insulating panel 29 is light and strong, because of its design as a box girder. Panels bonded together into complete wall panels 30, held in rigid metal frames 24 are used to assemble a complete tank, which is self-standing when empty. Such preassembled cryogenic tanks 27 are sufficiently sturdy to be uplifted and transported by barge over long distances to any shipyard where the inner hull of the ship is built. FIG. 8 also shows the air hoses 25, affixed to the outer surface of the cryogenic tank, in their deflated position. FIG. 9 shows a tank lifted with cranes and placed inside the open hull. The tank is then accurately positioned in the hull, by inflating by known means the network of air hoses 25 fastened to the tank outer surface. Such an operation is performed by means familiar to those skilled in the art, for instance by connecting both ends of each air hose respectively to two common header pipes used as inlet and outlet. Both the inlet and outlet header pipes are closed at one end. The open end of the inlet pipe 35 is connected to a source of warm gas under pressure, such as an air compressor 36. The open end of the outlet header pipe is connected to a pressure relief valve vented to the atmosphere. A thermosetting liquid adhesive 26 is poured to completely fill the spaces between hull, tank, and hoses. The ship deck structure is finally uplifted and placed over the cryogenic tank top, to be welded to the open hull structure. The same procedure (inflation of air hoses and filling of remaining space with adhesive) is then used to bond the upper part of the cryogenic tank to the ship's upper deck.

The method of construction of preassembled prismatic container includes the following steps, shown on FIG. 8*a*, 8*b*, and 8*c*.

assembly of complete wall panels, including one or several corner panels along one-half of its perimeter, 28.

Each assembly is held within a rigid metal frame 24 giving accurate positioning of the wall panel, during assembly, as well as additional support for handling.

Each prefabricated panel 29 entering into the assembly of a wall panel is temporarily attached to the metal frame in which it is assembled, preferably by means of suction cup 31, applying a force at various points of the reinforce plastic envelope on the back face of each prefabricated panel. Deflated air hoses 25 are bonded to the back of each prefabricated panel before assembly. The assembly of each wall panel is preferably done with the metal frame in a horizontal position, inside a covered hall. After complete curing of the adhesive joints and welding of all adjacent membrane edges, the integrity of both the secondary and primary barriers is checked, and any defect corrected.

The finished panel in its holding frame is rolled out of the assembly hall and picked up by mobile cranes, to be carried and placed against the edge panels of the other wall assemblies forming the prismatic container structure. The beveled edges of adjacent wall assemblies are bonded and pressed against each other. The prismatic structure assembly is done in the following sequence, shown on FIG. 8*c*.

One hexagonal transverse wall is held vertically by fastening its holding frame to a row of fixed vertical posts 32 buttressed in 33 to withstand any lateral forces due to wind pressure on the wall.

The bottom and longitudinal wall assemblies are bonded one by one to the edge panels on one half of the perimeter of the transverse well.

The second hexagonal transverse wall is then positioned and glued to the edge panels of the previously assemblied bottom and longitudinal wall assemblies.

The longitudinal wall and ceiling assemblies on the other half of the perimeter are individually positioned and bonded against the two previously erected transverse walls. All bonded joints are checked for liquid tightness and reinforced until satisfactory.

The longitudinal bellows-type expansion joints are then welded inside the completed container, and checked for gas tightness.

When all tests are satisfactory, the holding metal frames are separated one by one from the back face of the insulating panels and removed with the cranes. The completed prismatic container is then ready for shipment by barge to the shipyard where the ship's hull is under construction.

For the construction of LNG land storage tanks, including the same prefabricated insulating panels within a cylindrical structure made of prestressed concrete or steel, only the "on-site" construction method, using mobile telescopic towers, described previously, is applicable.

We claim:

1. A system of membrane-type cryogenic tanks for bulk storage and for marine transportation of liquid cryogens, comprising rigid insulating walls, a bottom and a roof covered on an inner face and edges of said tank by a flexible membrane and supported on an outside face of said tank by an inner surface of a load-bearing tank structure, such as the hull of a tanker, presenting limited roof hatch openings when completed, and more specifically a system in which (a) said insulating walls, bottom or roof of said cryogenic tank are made exclusively of prefabricated impervious rigid insulation panels bonded to each other in a rigid surface contact along their entire edge surfaces, by means of fast curing thermosetting adhesives to form a rigid structure; said prefabricated panels presenting a face in close proximity to said liquid, which is individually covered by a weldable cryogenic metal membrane fastened by deformable means to longtudinal edges of said panels during their prefabrication to provide a thermal-shock resistant barrier and said panels also presenting a back face which is partly covered by discontinuous fast curing thermosetting adhesive means of variable thickness to provide a surface to surface contact bond between said back face of said rigid panel and an irregular inner surface of said load-bearing tank structure over a fraction of said panel back face area, said fast curing thermosetting adhesive means being disposed in parallel bands so as to provide means for a gas circulation between said load-bearing tank inner surface and said panel back face, (b) said composite panels, being structurally equivalent to slender beams of length nearly equal to the height of a tank and which, exhibit sufficient rigidity to permit their handling, positioning and assembling to the performed in a single operation, by means of tooling designed so that the assembly line method of construction should be applicable to such a system.

2. A system according to claim 16 comprising:

(a) trihedral panels located at the corners of a prismatic tank, (b) edge panels extending between said trihedral panels, along the full length of the edges of said tank, (c) flat panels extending along said tank's wall, bottom or roof over the full distance separating such opposite edge panels, all said panels being made of rigid insulating foam prestressed in compression in the course of panel fabrication, such compressive prestressing being applied transversely to each panel by means of taut glass fibers stretched obliquely within an impervious glass-fabric-reinforced envelope totally surrounding each panel, and said applied prestressing compression effectively compensating the tensions developed in the foam of each panel by thermal stresses and by localized anchoring forces applied while the tank is in service, (d) thermosetting adhesive means providing a rigid bond between adjacent panels over the entire area of their edge surfaces, and (e) thermosetting adhesive means providing a resilient bond between the back face of each said panel and the load bearing tank inner wall over a fraction of their respective areas.

3. A system according to claim 2 in which the cryogenic metal membrane of said trihedral panels is formed into a concave dish-shaped multilobed form fixed at its center to the bottom of an oversized cavity in the insulating corner panel, said membrane presenting at least three rounded lobes so that said membrane's edge is a flexible corrugation which can freely unfold and extend uner the tension due to the thermal contractions of the adjacent edge panel's membranes.

4. A system according to claim 2 comprising impervious insulating foam panels in which taut glass fibers, used to prestress the insulating foam, are stretched within said impervious glass fabric-reinforced envelope, according to three principal directions oblique with respect to the membrane covered panel face, so that the resultant of the tensions in said fibers is a compressive force applied to said foam transversely to said panel's faces.

5. A system according to claim 2 in which (a) all tensions in the metal membrane of each flat panel are ultimately transmitted to the anchored deformable membrane of said trihedral panels by means of pleated membrane elements flexibly fastened to said insulation along all edges of the tank, (b) longitudinal edges of the membrane of each flat or edge panel are upturned and folded downward, (c) transverse edges of the membrane of each flat or edge panel are upturned and welded to the upturned part of the longitudinal edges of said membrane, so as to form a rigid rectangular frame (d) said pleated membrane elements are welded on one side to the folded longitudinal edge or to the upturned transverse edge of the adjacent membrane panels and on their other side to the folded part of the membrane of the adjacent edge panel.

6. A system according to claim 1, in which said prefabricated rigid insulating panels are bonded directly to said load bearing tank inner surface by means of parallel thermosetting adhesive mastic strips of variable thickness which are (a) extruded into a shape such that the outer surface of said strips, looking into the tank, defines a geometric plane independent of any irregularities of the load bearing surface, and (b) quickly cured by circulating hot air in the channels that said mastic strips separate in the interspace between the load bearing tank surface and panel backface.

7. A system according to claim 6, in which full length panels are erected within the enclosed space of said load bearing tank by means of telescopic towers of cross section smaller than the tank hatch opening, said towers being mobile along the periphery of the tank bottom and being fitted with four horizontal telescopic arms, the vertical position and horizontal extension of each of them is accurately controlled independently of the shape of the vessel wall surface.

8. A system according to claim 1, in which (a) the complete insulation and membrane containment of a membrane-type cryogenic tank are assembled into a self supporting prismatic structure capable of being subsequently transported and uplifted by cranes into said tanker hull while under construction, (b) said prismatic structure is then positioned by inflating air hoses fastened to the outer surface of said structrue, and subsequently affixed to the hull surface of said tanker by a thermosetting bonding agent filling each of the spaces separating said air hoses.

9. A system according to claim 8, in which each said wall, bottom and roof of said prismatic structure is pre-assembled into elements including at least one trihedral panel and at least one edge panel located on one half of the perimeter of each said element, together with a plurality of flat panels equipped with deflated air hoses, which said panels are adhesively bonded to each other along their adjacent edge surfaces and held together inside rigid removable metal frames so that membrane edges on all said panels can be welded together into a leak-proof tank face.

10. A system according to claim 9, in which pre-assembled tank faces held within rigid metal frames are adhesively bonded to each other to form a prismatic container structure, the outer surface of which is covered with parallel air hoses, and said pre-assembled tank faces have thicknesses such that after curing of all bonded joints and after welding of all said pleated membrane joints said prismatic container structure has sufficient rigidity to be self supporting after removal of said holding metal frames and to permit transportation of said self supporting prismatic container structure to a shipyard, for installation into said tanker hull under construction, before access into said hull is limited to said hatch openings, 11. A system according to claim 8 in which said self supporting prismatic structure is adhesively bonded to said tanker hull by means of a thermosetting plastic resin poured in liquid form into said spaces separating adjacent air hoses and quickly cured by the heat provided by a circulation of hot gas through said adjacent hoses, under a slight pressure so that each said hose in its inflated position is in sealing contact over its entire length with said hull inner surface as well as with said prismatic outer surface, while said prismatic structure is suspended from a crane.

* * * * *